US006699816B2

(12) United States Patent
Iwasaki et al.

(10) Patent No.: US 6,699,816 B2
(45) Date of Patent: Mar. 2, 2004

(54) HEAT-SENSITIVE RECORDING MATERIAL

(75) Inventors: Masayuki Iwasaki, Shizuoka-ken (JP); Tsutomu Watanabe, Shizuoka-ken (JP); Hirofumi Mitsuo, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 72 days.

(21) Appl. No.: 10/187,430

(22) Filed: Jul. 2, 2002

(65) Prior Publication Data

US 2003/0134746 A1 Jul. 17, 2003

(30) Foreign Application Priority Data

Jul. 3, 2001 (JP) ..... 2001-202006
Jul. 3, 2001 (JP) ..... 2001-202007

(51) Int. Cl.[7] ..... B41M 5/30
(52) U.S. Cl. ..... 503/209; 503/216
(58) Field of Search ..... 503/208, 209, 503/216

(56) References Cited

U.S. PATENT DOCUMENTS 6,642,175 B2 * 11/2003 Mitsuo et al. ..... 503/209

FOREIGN PATENT DOCUMENTS

| | | | |
|---|---|---|---|
| JP | 4-20792 | | 12/1984 |
| JP | 6-179290 | | 6/1994 |
| JP | 200311522 A | * | 1/2003 |

OTHER PUBLICATIONS

Japanese Abstract No. 2000247038, dated Sep. 12, 2000.

* cited by examiner

*Primary Examiner*—N. Edwards
(74) *Attorney, Agent, or Firm*—Sughrue Mion, PLLC

(57) ABSTRACT

A heat-sensitive recording material in which a heat-sensitive color-developing layer containing at least an electron-donating colorless dye, an electron-accepting compound, a sensitizer and preferably an image stabilizer is disposed on a support, the heat-sensitive color-developing layer containing (1) 4-hydroxybenzenesulfonanilide as the electron-accepting compound and (2) 2-benzyloxynaphthalene and ethylenebisstearic acid amide or methylolstearic acid amide as the sensitizer, and (3) the 2-benzyloxynaphthalene (x) to ethylenebisstearic acid amide or methylolstearic acid amide (y) mass ratio (x/y) being within 95/5 to 40/60 range.

19 Claims, No Drawings

HEAT-SENSITIVE RECORDING MATERIAL

BACKGROUND OF THE INVENTION

1. Field of the Invention

The present invention relates to a heat-sensitive recording material. More specifically, it relates to a heat-sensitive recording material, which has a high color optical density and has excellent image stability, chemical resistance, head matching (sticking) property, suitability for ink jet recording and ink jet sheet resistance.

2. Description of the Related Art

In general, a heat-sensitive recording material is relatively inexpensive, and a recording appliance therefor is compact and maintenance-free. Accordingly, the heat-sensitive recording material has found wide acceptance. Recently, competition in sales of the heat-sensitive recording material has intensified, and a higher performance distinguished from an ordinary performance is being required of the heat-sensitive recording materials. To meet requirement, studies on a color optical density, an image stability and a head matching property of a heat-sensitive recording material have been earnestly conducted.

In ordinary heat-sensitive recording materials, 2,2-bis(4-hydroxyphenyl)propane (so-called "bisphenol A") has been widely used as an electron-accepting compound which, reactions with an electron-donating colorless dye to make a colorless coating material, develop a color. Nevertheless, in these heat-sensitive recording materials, a sensitivity, background fogging, an image stability, a chemical resistance and a heat matching (sticking) property have not all been satisfied at the same time.

Japanese Patent Application Publication (JP-B) No. 4-20792 discloses a recording material which uses an N-substituted sulfamoylphenol or an N-substituted sulfamoylnaphthol as an electron-accepting compound, and discloses that this recording material (pressure-sensitive, heat-sensitive) has improved image density, image stability and cost. However, there is still room for further improvements to the image density and the image stability.

Moreover, when a full-color information is recorded in a heat-sensitive recording material, recording is sometimes conducted using ink jet printing ink. However, when an ordinary heat-sensitive recording material is subjected to ink jet recording, a color of ink is not faithfully reproduced, nor is a vivid color given. A color may become dull, and information recorded in a heat-sensitive mode may be lost. Further, when a sheet that was recorded by an ink jet system comes into contact with a heat-sensitive recording paper, a heat-sensitive recording image may be lost.

SUMMARY OF THE INVENTION

An object of the present invention is to provide a heat-sensitive recording material having a high color optical density and an excellent stability of an image area, chemical resistance, ink jet recordability, ink jet sheet resistance and head matching (sticking) property.

The present inventors have assiduously researched electron-accepting compounds, sensitizers and image stabilizers, and have developed an excellent heat-sensitive recording material to complete the present invention.

That is, the object of the present invention is attained by the following ways.

A first aspect of the present invention is a heat-sensitive recording material comprising a support having disposed thereon a heat-sensitive color-developing layer including an electron-donating colorless dye, 4-hydroxybenzenesulfoanilide as an electron-accepting compound, and 2-benzyloxynaphthalene and ethylenebisstearic acid amide as a sensitizer, wherein a mass ratio (x/y) of the 2-benzyloxynaphthalene (x) to the ethylenebisstearic acid amide (y) is from 95/5 to 40/60.

A second aspect of the present invention is a heat-sensitive recording material comprising a support having disposed thereon a heat-sensitive color-developing layer including an electron-donating colorless dye, 4-hydroxybenzenesulfoanilide as an electron-accepting compound, 2-benzyloxynaphthalene and methylolstearic acid amide as a sensitizer, and 1,1,3-tris(2-methyl-4-hydroxy-5-tert-butylphenyl)butane and 1,1,3-tris(2-methyl-4-hydroxy-5-cyclohexylphenyl)butane as an image stabilizer, wherein a mass ratio (x/y) of the 2-benzyloxynaphthalene (x) to the methylolstearic acid amide (y) is from 95/5 to 40/60.

A third aspect of the present invention is the heat-sensitive recording material, according to the first aspect, wherein the heat-sensitive color-developing layer further comprising, as an image stabilizer, at least one of 1,1,3-tris(2-methyl-4-hydroxy-5-tert-butylphenyl)butane and 1,1,3-tris(2-methyl-4-hydroxy-5-cyclohexylphenyl)butane.

A fourth aspect of the present invention is the heat-sensitive recording material, according to the first or second aspect, wherein a dry weight coating amount of the electron-donating colorless dye comprises from 0.1 to 1.0 g/m$^2$.

A fifth aspect of the present invention is the heat-sensitive recording material, according to the first or second aspect, wherein the amount according to the image stabilizer comprises from 10 to 100 parts by mass relative to 100 parts by mass according to the electron-donating colorless dye.

A sixth aspect of the present invention is the heat-sensitive recording material, according to the first or second aspect, wherein the amount according to 4-hydroxybenzenesulfonanilide as the electron-accepting compound comprises from 50 to 400% by mass relative to the electron-donating colorless dye.

A seventh aspect of the present invention is the heat-sensitive recording material, according to the first or second aspect, wherein the total amount of the sensitizer comprises from 75 to 200 parts by mass relative to 100 parts by mass of 4-hydroxybenzenesulfonanilide as the electron-accepting compound.

An eighth aspect of the present invention is the heat-sensitive recording material, according to the first or second aspect, wherein the heat-sensitive color-developing layer further comprising, as an inorganic pigment, at least one selected from the group consisting of precipitated calcium carbonate, calcium hydroxide and amorphous silica.

A ninth aspect of the present invention is the heat-sensitive recording material, according to the first or second aspect, wherein the heat-sensitive color-developing layer further comprising, as a mordant, a compound including at least one cationic group selected from the group consisting of amide groups, imide groups, primary amino groups, secondary amino groups, tertiary amino groups, a primary ammonium salt groups, secondary ammonium salt groups, tertiary ammonium salt groups and quaternary ammonium salt groups.

A tenth aspect of the present invention is the heat-sensitive recording material, according to the first or second aspect, wherein the heat-sensitive color-developing layer is formed by coating with a curtain coater and drying.

An eleventh aspect of the present invention is the heat-sensitive recording material, according to the first or second aspect, further comprising a protective layer disposed on the heat-sensitive recording layer.

DESCRIPTION OF THE PREFERRED EMBODIMENTS

In the first aspect of the present invention, the heat-sensitive recording material comprising a support having disposed thereon a heat-sensitive color-developing layer including an electron-donating colorless dye, 4-hydroxybenzenesulfoanilide as an electron-accepting compound, and 2-benzyloxynaphthalene and ethylenebisstearic acid amide as a sensitizer, wherein a mass ratio (x/y) of the 2-benzyloxynaphthalene (x) to the ethylenebisstearic acid amide (y) is from 95/5 to 40/60.

Further, in the second aspect of the present invention, the heat-sensitive recording material comprising a support having disposed thereon a heat-sensitive color-developing layer including an electron-donating colorless dye, 4-hydroxybenzenesulfoanilide as an electron-accepting compound, 2-benzyloxynaphthalene and methylolstearic acid amide as a sensitizer, and 1,1,3-tris(2-methyl-4-hydroxy-5-tert-butylphenyl)butane and 1,1,3-tris(2-methyl-4-hydroxy-5-cyclohexylphenyl)butane as an image stabilizer, wherein a mass ratio (x/y) of the 2-benzyloxynaphthalene (x) to the methylolstearic acid amide (y) is from 95/5 to 40/60.

With respect to the heat-sensitive recording material in the present invention, the heat-sensitive color-developing layer and the support are described below.

(Heat-sensitive Color-developing Layer)

In the first aspect of the heat-sensitive recording material in the present invention, the heat-sensitive color-developing layer disposed on the support comprises at least the electron-donating colorless dye, the electron-accepting compound and the sensitizer. To further increase the image stability, it is preferable that the heat-sensitive color-developing layer of the present invention includes the heat stabilizer. Moreover, the heat-sensitive color-developing layer may include, as required, a pigment, an adhesive, an ultraviolet absorbent and the like.

In the second aspect of the heat-sensitive recording material in the present invention, the heat-sensitive color-developing layer disposed on the support comprises at least the electron-donating colorless dye, the electron-accepting compound, the sensitizer and the image stabilizer. Moreover, the heat-sensitive recording material of the present invention may contain, as required, a pigment, an adhesive, an ultraviolet absorbent and the like.

<Electron-donating Colorless Dye>

The electron-donating colorless dye according to the present invention is essentially a colorless dye, and has a property of color development by donating an electron or accepting a proton from an acid.

The electron-donating colorless dye of the present invention is preferably one selected from 2-anilino-3-methyl-6-diethylaminofluoran, 2-anilino-3-methyl-6-(N-ethyl-N-isoamylamino)fluoran and 2-anilino-3-methyl-6-(N-ethyl-N-propylamino)fluoran. These may be used either singly or in combinations of three or more.

A color optical density, an image stability and a chemical resistance can be all the more improved by using at least one selected from 2-anilino-3-methyl-6-diethylaminofluoran, 2-anilino-3-methyl-6-(N-ethyl-N-isoamylamino)fluoran and 2-anilino-3-methyl-6-(N-ethyl-N-propylamino)fluoran.

In the electron-donating colorless dye according to the present invention, except the foregoing three fluoran compounds, for example, 3-di(n-butylamino)-6-methyl-7-anilinofluoran, 2-anilino-3-methyl-6-N-ethyl-N-sec-butylaminofluoran, 3-di(n-pentylamino)-6-methyl-7-anilinofluoran, 3-(N-n-hexyl-N-ethylamino)-6-methyl-7-anilinofluoran, 3-[N-(3-ethoxypropyl)-N-ethylamino)-6-methyl-7-anilinofluoran, 3-di(n-butylamino)-7-(2-chloroanilino)fluoran, 3-diethylamino-7-(2-chloroanilino)fluoran and 3-(N-cyclohexyl-N-methylamino)-6-methyl-7-anilinofluoran may be used. These may be used in combination with the foregoing preferable fluoran compounds.

When the other fluoran compounds are used in combination, the foregoing preferable three fluoran compounds are included in amounts of, preferably at least 50% by mass, more preferably at least 70% by mass relative to the total amount of the all electron-accepting compounds.

The coating amount of the electron-donating colorless dye is preferably 0.1 to 1.0 g/m$^2$ in terms of a dry weight. It is more preferably from 0.2 to 0.5 g/m$^2$ to improve a color optical density and suppress background fogging.

<Electron-accepting Compound>

The heat-sensitive recording material of the present invention comprises 4-hydroxybenzenesulfonanilide as the electron-accepting compound. Since the heat-sensitive recording material of the present invention comprises 4-hydroxybenzenesulfonanilide in the heat-sensitive color-developing layer as the electron-accepting compound, it is possible to increase a color optical density, suppress background fogging and improve a chemical resistance and a head matching (sticking) property.

The amount of the electron-accepting compound (4-hydroxybenzenesulfonanilide) is preferably from 50 to 400% by mass, more preferably from 100 to 300% by mass, especially preferably from 150 to 250% by mass relative to the electron-donating colorless dye. When the amount thereof is less than 50% by mass, the foregoing effects are sometimes insufficient. When it exceeds 400% by mass, the effects are unnecessarily saturated, and the background fogging may increase or the chemical resistance may be impaired.

As the electron-accepting compound of the present invention, known electron-accepting compounds other than 4-hydroxybenzenesulfonamilide can also be used in combination unless the effects of the present invention are impaired.

The other known electron-accepting compounds can properly be selected from known compounds. Especially in view of suppressing the background fogging, phenolic compounds or salicylic acid derivatives and polyvalent metal salts thereof are preferable.

Examples of the phenolic compounds include 2,2'-bis(4-hydroxyphenol)propane(bisphenol A), 4-tert-butylphenol, 4-phenylphenol, 4-hydroxydiphenoxide, 1,1'-bis(4-hydroxyphenyl)cyclohexane, 1,1'-bis(3-chloro-4-hydroxyphenyl)cyclohexane, 1,1'-bis(3-chloro-4-hydroxyphenyl)-2-ethylbutane, 4,4'-sec-isooctylidenediphenol, 4,4'-sec-butylilenediphenol, 4-tert-octylphenol, 4-p-methylphenylphenol, 4,4'-methylcyclohexylidenephenol, 4,4'-isopentylidenephenol, 4-hydroxy-4-isopropyloxydiphenylsulfone, benzyl p-hydroxybenzoate, 4,4'-dihydroxydiphenylsulfone, 2,4'-dihydroxydiphenylsulfone, N-(4-hydroxyphenyl)-p-toluenesulfonamide and 2,4-bis(phenylsulfonyl)phenol.

Further, examples of the salicylic acid derivatives and the polyvalent metal salts thereof include 4-pentadecylsalicylic acid, 3,5-di(α-methylbenzyl)salicylic acid, 3,5-di(tert-octyl)salicylic acid, 5-octadecylsalicylic acid, 5-α-(p-α-methylbenzylphenyl)ethylsalicylic acid, 3-α-methylbenzyl-5-tert-octylsalicylic acid, 5-tetradecylsalicylic acid, 4-hexyloxysalicylic acid, 4-cyclohexyloxysalicylic acid, 4-decyloxysalicylic acid, 4-dodecyloxysalicylic acid, 4-pentadecyloxysalicylic acid, 4-octadecyloxysalicylic acid, and zinc, aluminum, calcium, copper and lead salts thereof.

When the other known electron-accepting compounds are used in combination in the present invention, the amounts thereof are preferably at least 50% by mass, and more preferably at least 70% by mass relative to the total amount of all electron-accepting compounds for 4-hydroxybenzenesulfonamilide.

In the present invention, when preparing a coating solution of the heat-sensitive color-developing layer, the particle size of the electron-accepting compound is preferably 1.0 μm or less, and more preferably from 0.4 to 0.7 μm in terms of a volume-average particle size. When the volume-average particle size is 1.0 μm or less, there is an advantage that a heat sensitivity is increased. The volume-average particle size can easily be measured with a laser diffraction-type particle size distribution measuring device (for example, "LA500", manufactured by Horiba Ltd.).

<Sensitizer>

In the first aspect of the heat-sensitive recording material in the present invention, the heat-sensitive color-developing layer comprises 2-benzyloxynaphthalene and ethylenebisstearic acid amide as the sensitizer. Thus, a sensitivity can greatly be improved while suppressing occurrence of background fogging.

In the present invention, the 2-benzyloxynaphthalene (x) to ethylenebisstearic acid amide (y) ratio (x/y) is used in a range of from 95/5 to 40/60. When the mass ratio (x/y) exceeds this range, the sensitivity is decreased. When it is less than the range, the sensitivity is also decreased. The mass ratio (x/y) is preferably from 90/10 to 50/50, and more preferably from 85/15 to 60/40.

The total amount of the sensitizer is preferably from 75 to 200 parts by mass, and more preferably from 100 to 150 parts by mass relative to 100 parts by mass of 4-hydroxybenzenesulfonanilide as the electron-accepting compound. When the total amount of the sensitizer is in the range of from 75 to 200 parts by weight, the effect of improving a sensitivity is great, and the image stability is also good.

The heat-sensitive color-developing layer in the first aspect of the heat-sensitive recording material in the present invention may comprises, in addition to the 2-benzyloxynaphthalene and the ethylenebisstearic acid amide, other known sensitizers that do not impair the effects of the present invention. When the heat-sensitive color-developing layer comprises the other sensitizers, amounts thereof are preferably at least 50% by mass, and more preferably at least 70% by mass relative to the total amount of all sensitizers.

Examples of the other known sensitizers include aliphatic monoamides, stearylurea, p-benzylbiphenyl, di(2-methylphenoxy)ethane, di(2-methoxyphenoxy)ethane, β-naphthol-(p-methylbenzyl) ether, α-naphthylbenzyl ether, 1,4-butanediol-p-methylphenyl ether, 1,4-butanediol-p-isopropylphenyl ether, 1,4-butanediol-p-tert-octylphenyl ether, 1-phenoxy-2-(4-ethylphenoxy)ethane, 1-phenoxy-2-(chlorophenoxy)ethane, 1,4-butanediolphenyl ether, diethylene glycol bis(4-methoxyphenyl) ether, m-terphenyl, oxalic acid methylbenzyl ether, 1,2-diphenoxymethylbenzene, 1,2-bis(3-methylphenoxy)ethane and 1,4-bis(phenoxymethyl) benzene.

Next, in the second aspect of the heat-sensitive recording material in the present invention, the heat-sensitive color-developing layer comprises 2-benzyloxynaphthalene and methylolstearic acid amide as the sensitizer. Thus, a sensitivity can greatly be improved while suppressing occurrence of background fogging.

In the present invention, the 2-benzyloxynaphthalene (x) to methylolstearic acid amide (y) ratio (x/y) is used in the range of from 95/5 to 40/60. When the mass ratio (x/y) exceeds this range, the sensitivity is decreased. When it is less than the range, the sensitivity is also decreased. The mass ratio (x/y) is preferably from 90/10 to 50/50, and more preferably from 85/15 to 60/40.

The total amount of the sensitizer is preferably from 75 to 200 parts by mass, and more preferably from 100 to 150 parts by mass relative to 100 parts by mass of 4-hydroxybenzenesulfonanilide as the electron-accepting compound. When the total amount of the sensitizer is in the range of from 75 to 200 parts by mass, the effect of improving the sensitivity is increased, and the image stability is also good.

The heat-sensitive color-developing layer of the heat-sensitive recording material in the present invention may comprise, in addition to 2-benzyloxynaphthalene and methylolstearic acid amide, other known sensitizers unless the effects of the present invention are impaired. When the other sensitizers are contained, the amounts thereof are preferably at least 50% by mass, more preferably at least 70% by mass relative to the total amount of all sensitizers.

Examples of the other known sensitizers include aliphatic monoamides, stearylurea, p-benzylbiphenyl, di(2-methylphenoxy)ethane, di(2-methoxyphenoxy)ethane, β-naphthol-(p-methylbenzyl) ether, α-naphthylbenzyl ether, 1,4-butanediol-p-methylphenyl ether, 1,4-butanediol-p-isopropylphenyl ether, 1,4-butanediol-p-tert-octylphenyl ether, 1-phenoxy-2-(4-ethylphenoxy)ethane, 1-phenoxy-2-(chlorophenoxy)ethane, 1,4-butanediolphenyl ether, diethylene glycol bis(4-methoxyphenyl)ether, m-terphenyl, oxalic acid methylbenzyl ether, 1,2-diphenoxymethylbenzene, 1,2-bis(3-methylphenoxy)ethane and 1,4-bis(phenoxymethyl) benzene.

<Image Stabilizer>

In the first aspect of the heat-sensitive recording material in the present invention, the heat-sensitive color-developing layer can include the image stabilizer for improving more a stability of an image area. As the image stabilizer, phenol compounds, especially hindered phenol compounds are effective. Examples thereof include 1,1,3-tris(2-methyl-4-hydroxy-5-tert-butylphenyl)butane, 1,1,3-tris(2-methyl-4-hydroxy-5-cyclohexylphenyl)butane, 1,1,3-tris(2-ethyl-4-hydroxy-5-cyclohexylphenyl)butane, 1,1,3-tris(3,5-di-tert-butyl-4-hydroxyphenyl)butane, 1,1,3-tris(2-methyl-4-hydroxy-5-tert-butylphenyl)propane, 2,2'-methylenebis(6-tert-butyl-4-methylphenol), 2,2'-methylenebis(6-tert-butyl-4-ethylphenol), 4,4'-butylidenebis(6-tert-butyl-3-methylphenol) and 4,4'-thiobis(3-methyl-6-tert-butylphenol). In the present invention, it is preferable that the heat-sensitive color-developing layer comprises, among these compounds, at least one of 1,1,3-tris(2-methyl-4-hydroxy-5-tert-butylphenyl)butane and 1,1,3-tris(2-methyl-4-hydroxy-5-cyclohexylphenyl)butane.

When the heat-sensitive color-developing layer comprises 1,1,3-tris(2-methyl-4-hydroxy-5-tert-butylphenyl)butane and/or the 1,1,3-tris(2-methyl-4-hydroxy-5-cyclohexylphenyl)butane as the image stabilizer, it is possible to improve the background fogging and greatly improve the stability of the image area. 1,1,3-Tris(2-methyl-4-hydroxy-5-tert-butylphenyl)butane (α) and 1,1,3-tris(2-methyl-4-hydroxy-5-cyclohexylphenyl)butane (β) may be used either singly or in combination. When they are used in combination, the mass ratio (α/β) is preferably from 20/80 to 80/20, and more preferably from 40/60 to 60/40.

The total amount of the image stabilizer is preferably from 10 to 100 parts by mass, and more preferably from 20 to 60 parts by mass relative to 100 parts by mass of the electron-donating colorless dye in view of efficiently exhibiting desired effects of the background fogging, the image stability, the chemical resistance and the head matching (sticking) property.

Further, in addition to the 1,1,3-tris(2-methyl-4-hydroxy-5-tert-butylphenyl)butane or the 1,1,3-tris(2-methyl-4-hydroxy-5-cyclohexylphenyl)butane, other known image stabilizers may be used in combination. When other known image stabilizers are used in combination, the amount of the 1,1,3-tris(2-methyl-4-hydroxy-5-tert-butylphenyl)butane and/or the 1,1,3-tris(2-methyl-4-hydroxy-5-cyclohexylphenyl)butane is preferably at least 50% by mass, and more preferably at least 70% by mass relative to the total amount of all image stabilizers.

Next, in the second aspect of the heat-sensitive recording material in the present invention, the heat-sensitive color-developing layer comprises at least one of 1,1,3-tris(2-methyl-4-hydroxy-5-tert-butylphenyl)butane and 1,1,3-tris (2-methyl-4-hydroxy-5-cyclohexylphenyl)butane as the image stabilizer. When the heat-sensitive color-developing layer comprises the image stabilizer, it is possible to suppress the background fogging and greatly improve a stability of the image area due to a synergistic effect of 4-hydroxybenzenesulfonanilide as the electron-accepting compound and 2-benzyloxynaphthalene and methylolstearic acid amide as the sensitizer.

The 1,1,3-tris(2-methyl-4-hydroxy-5-tert-butylphenyl) butane (α) and the 1,1,3-tris(2-methyl-4-hydroxy-5-cyclohexylphenyl)butane (β) may be used either singly or in combination. When they are used in combination, the mass ratio (α/β) is preferably from 20/80 to 80/20, and more preferably from 40/60 to 60/40.

The total amount of the image stabilizer is preferably from 10 to 100 parts by mass, and more preferably from 20 to 60 parts by mass relative to 100 parts by mass of the electron-donating colorless dye in view of efficiently exhibiting desired effects of the background fogging, the image stability, the chemical resistance and the head matching (sticking) property.

In the second aspect of the heat-sensitive recording material in the present invention, in addition to the 1,1,3-tris(2-methyl-4-hydroxy-5-tert-butylphenyl)butane and the 1,1,3-tris(2-methyl-4-hydroxy-5-cyclohexylphenyl)butane, other known image stabilizers may be used in combination. When other known image stabilizers are used in combination, the amount of the 1,1,3-tris(2-methyl-4-hydroxy-5-tert-butylphenyl)butane and/or the 1,1,3-tris(2-methyl-4-hydroxy-5-cyclohexylphenyl)butane is preferably at least 50% by mass, more preferably at least 70% by mass relative to the total amount of all image stabilizers.

As other known image stabilizers, phenol compounds, especially hindered phenol compounds are effective. Examples thereof include 1,1,3-tris(2-ethyl-4-hydroxy-5-cyclohexylphenyl) butane, 1,1,3-tris(3,5-di-tert-butyl-4-hydroxyphenyl)butane, 1,1,3-tris(2-methyl-4-hydroxy-5-tert-butylphenyl)propane, 2,2'-methylenebis(6-tert-butyl-4-methylphenol), 2,2'-methylenebis(6-tert-butyl-4-ethylphenol), 4,4'-butylidenebis(6-tert-butyl-3-methylphenol) and 4,4'-thiobis(3-methyl-6-tert-butylphenol).

<Inorganic Pigment>

The heat-sensitive recording material of the present invention may comprise, as required, an inorganic pigment in the heat-sensitive color-developing unless this would impair the effects of the present invention. As the inorganic pigment, it is preferable to use precipitated calcium carbonate, aluminum hydroxide and amorphous silica either singly or in combination. When the precipitated calcium carbonate and/or the aluminum hydroxide and/or the amorphous silica is contained as the inorganic pigment, background fogging or an abrasion of a thermal head can be reduced. It is further possible to prevent adhesion of refuse to the thermal head or improve the sticking property. Moreover, incorporation of amorphous silica can prevent blotting by ink jet recording.

The amount of the inorganic pigment is preferably from 50 to 250 parts by mass, more preferably from 70 to 170 parts by mass, and especially preferably from 90 to 140 parts by mass relative to 100 parts by mass of the electron-accepting compound in view of the color optical density and adhesion of refuse to a thermal head.

Further, a particle size of the inorganic pigment is preferably from 0.6 to 2.5 μm, more preferably from 0.8 to 2.0 μm, and especially preferably from 1.0 to 1.6 μm in terms of a volume-average particle size in view of a color optical density and adhesion of refuse to the thermal head as well.

Precipitated calcium carbonate generally has a crystal form of calcite, aragonite or vaterite. As the inorganic pigment used in the present invention, a precipitated calcium carbonate having a calcite crystal form is preferable in view of absorption and hardness. Further, a particulate form is preferably a spindle-shaped or scalenohedral form.

The precipitated calcium carbonate having a calcite crystal form can be formed by a known method.

Examples of the other inorganic pigment include calcium carbonate except for precipitated calcium carbonate having the calcite crystal form, barium sulfate, lithopone, agalmatolite, kaolin and calcined kaolin. When the precipitated calcium carbonate and an other inorganic pigment are used in combination, the ratio of the total mass (v) of precipitated calcium carbonate and the total mass (w) of the other inorganic pigment (v/w) is preferably from 100/0 to 60/40, more preferably from 100/0 to 80/20.

<Adhesive>

In the heat-sensitive recording material of the present invention, the heat-sensitive color-developing layer may contain an adhesive so long as this does not impair the effects of the present invention.

In recent years, as the heat-sensitive recording material has been used in various fields, it has been sometimes employed in offset printing. However, the heat-sensitive recording material generally has a low surface strength, and therefore, has a problem of a poor printability, for example, picking, which may occur during offset printing. In order to solve this problem, the printability in offset printing can be improved by incorporating the adhesive in the heat-sensitive color-developing layer.

As the adhesive, polyvinyl alcohol having a degree of saponification of from 85 to 99 mol % and a degree of polymerization of from 200 to 2,000 is preferable. Incorporation of this polyvinyl alcohol makes it possible to increase an interlaminar adhesion between the heat-sensitive color-developing layer and the support while maintaining a color optical density of the heat-sensitive recording material to improve printability and prevent the picking, for example. The degree of saponification is preferably from 85 to 99 mol %. When the degree of saponification is within the range of from 85 to 99 mol %, it is possible to prevent the picking that takes place due to a poor resistance to wetting water used in offset printing and to prevent, during preparation of a coating solution, formation of an undissolved substance that causes occurrence of a defective portion. Further, it is advisable to use polyvinyl alcohol having a degree of polymerization of from 200 to 2,000. When the degree of polymerization is within the range of from 200 to 2,000, there is no need to increase the amount of the polyvinyl alcohol. Accordingly, the decrease in the image density owing to the increase in the amount does not occur. Moreover, since polyvinyl alcohol is easily soluble in a solvent without increasing a viscosity of a coating solution, its formation and coating thereof are easy. The degree of polymerization herein refers to an average degree of polymerization measured by the method according to JIS-K 6726 (1994).

The amount of polyvinyl alcohol in the heat-sensitive color-developing layer is preferably from 30 to 300% by mass, more preferably from 70 to 200% by mass, especially preferably from 100 to 170% by mass relative to 100 parts by mass of the electron-donating colorless dye in view of a color optical density and an offset printability (picking). The polyvinyl alcohol incorporated in the heat-sensitive color-developing layer acts not only as the adhesive for enhancing an interlaminar adhesion but also as a dispersing agent, a binder or the like.

Polyvinyl alcohol that meets conditions of the degree of saponification of from 85 to 99 mol % and the degree of polymerization of from 200 to 2,000 is preferable. However, in view of the color optical density in recording with the thermal head, it is advisable to use at least one selected from sulfo-modified polyvinyl alcohols, diacetone-modified polyvinyl alcohols and acetoacetyl-modified polyvinyl alcohols.

The sulfo-modified polyvinyl alcohols, the diacetone-modified polyvinyl alcohols and the acetoacetyl-modified polyvinyl alcohols may be used either singly or in combination, or together with another polyvinyl alcohol. When another polyvinyl alcohol is used together, the sulfo-modified polyvinyl alcohol, the diacetone-modified polyvinyl alcohol and the acetoacetyl-modified polyvinyl alcohol are contained in amounts of, preferably at least 10% by mass, and more preferably at least 20% by mass relative to the total amount of polyvinyl alcohols.

The sulfo-modified polyvinyl alcohol can be formed by a method of saponifying a polymer obtained by polymerizing an olefin sulfonic acid such as ethylenesulfonic acid, allylsulfonic acids or metaallylsulfonic acids or salts thereof and a vinyl ester such as a vinyl acetate in alcohol or an alcohol/water mixed solvent, a method of copolymerizing a mid-sodium salt and a vinyl ester such as vinyl acetate and saponifying the resulting copolymer, a method of treating polyvinyl alcohol with bromine or iodine and heating the product in an acidic sodium sulfite aqueous solution, a method of heating polyvinyl alcohol in a high concentration sulfuric acid aqueous solution or a method of acetalizing polyvinyl alcohol with an aldehyde compound containing a sulfonic acid group.

The diacetone-modified polyvinyl alcohol is a partially or completely saponified product of a copolymer of a monomer containing a diacetone group and a vinyl ester, and it is formed by saponifying a resin obtained by copolymerizing a monomer having a diacetone group with a vinyl ester.

In the diacetone-modified polyvinyl alcohol, the content of the monomer (recurring unit structure) having the diacetone group is not particularly limited.

The acetoacetyl-modified polyvinyl alcohol can generally be formed by adding a liquid or gaseous diketene to a polyvinyl alcohol resin solution, dispersion or powder. A degree of acetylation of the acetoacetyl-modified polyvinyl alcohol can be properly selected depending on desired qualities of the heat-sensitive recording material.

<Ultraviolet Absorbent>

In the heat-sensitive recording material of the present invention, the heat-sensitive color-developing layer may contain an ultraviolet absorbent unless this would impair the effects of the present invention. Examples of the ultraviolet absorbent that can be used in the present invention are as follows.

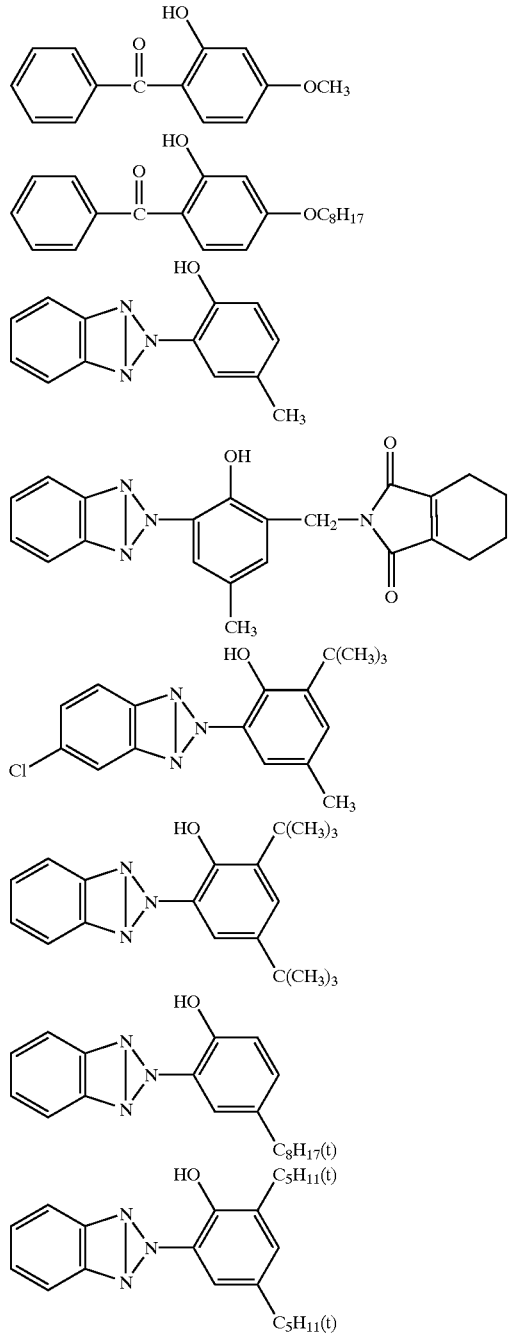

-continued

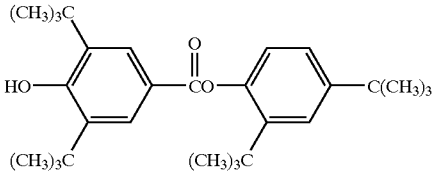

<Binder>

In the present invention, the electron-donating colorless dye, the electron-accepting compound and the sensitizer can be dispersed in a water-soluble binder. The water-soluble binder used in this case is preferably a compound, which is dissolved in water of 25° C. in an amount of at least 5% by mass.

Specific examples of the water-soluble binder include polyvinyl alcohol, methylcellulose, carboxymethylcellulose, starches (including modified starches), gelatins, gum arabic, casein and a saponified product of a styrene-maleic anhydride copolymer.

These binders are used not only in dispersion but also for improving a film strength of the heat-sensitive color-developing layer. For this purpose, a synthetic polymer latex-type binder such as a styrene-butadiene copolymer, a vinyl acetate copolymer, an acrylonitrile-butadiene copolymer, a methyl acrylate-butadiene copolymer or a polyvinylidene chloride can also be used in combination.

The electron-donating colorless dye, the electron-accepting compound and the sensitizer are dispersed with a stirring pulverizer such as a ball mill, an attritor or a sand mill either simultaneously or separately to form a coating solution. The coating solution may further contain, as required, a pigment, a metallic soap, a wax and a surfactant, as well as an antioxidant, the foregoing ultraviolet absorbent, a defoamer and a fluorescent dye.

As the pigment, calcium carbonate, barium sulfate, lithopone, agalmatolite, kaolin, calcined kaolin, amorphous silica and aluminum hydroxide are used. As the metallic soap, higher fatty acid metal salts are used, examples thereof being zinc stearate, calcium stearate and aluminum stearate.

As the wax, a paraffin wax, a microcrystalline wax, a carnauba wax, a methylolstearoamide wax, a polyethylene wax, a polystyrene wax and a fatty acid amide wax can be used either singly or in combination. As the surfactant, a sulfosuccinic acid alkali metal salt and a fluorine-containing surfactant are used.

Moreover, in the present invention, blotting in ink jet recording can be prevented by incorporating a mordant.

As the mordant, a compound containing at least one cationic group selected from an amide group, an imide group, a primary amino group, a secondary amino group, a tertiary amino group, a primary ammonium salt group, a secondary ammonium salt group, a tertiary ammonium salt group and a quaternary ammonium salt group is preferable. Specific examples thereof can include polyvinylbenzyltrimethylammonium chloride, polydiallyldimethylammonium chloride, polymethacryloyloxyethyl-β-hydroxyethyldimethylammonium chloride, polydimethylaminoethyl methacrylate hydrochloride, polyethylenimine, polyallylamine, polyallylamine hydrochloride, a polyamide-polyamine resin, cationized starch, a dicyandiamide formalin condensate and a dimethyl-2-hydroxypropylammonium salt polymer. The molecular weight of these compounds is preferably from 1,000 to 20,000. When the molecular weight is less than 1,000, a water resistance thereof tends to be unsatisfactory. When it is more than 20,000, a viscosity is increased, and a handleability may become poor.

The components contained in the heat-sensitive color-developing layer are mixed, and then coated on the support. The coating is conducted by a method using an air knife coater, a roll coater, a blade coater or a curtain coater. The heat-sensitive recording material of the present invention is coated on the support, dried, smoothed with a calender, and then actually used. As the coating method, a method using a curtain coater is especially preferable in the present invention because the heat-sensitive color-developing layer can uniformly be coated and a sensitivity and an image stability are efficiently improved.

A coating amount of the heat-sensitive color-developing layer is not particularly limited. It is usually from 2 to 7 g/m$^2$ in terms of a dry weight.

(Support)

As the support used in the present invention, a known support can be used. Specific examples thereof include a paper support such as a woodfree paper, a coated paper obtained by coating a resin or a pigment on paper, a resin-laminated paper, an undercoat base paper having an undercoat layer, a synthetic paper and a plastic film. In view of a thermal head matching property, an undercoat base paper having an undercoat layer is preferable, and an undercoat base paper in which an undercoat layer containing an oil-absorbable pigment is formed with a blade coater is especially preferable.

As the support, a smooth support having a smoothness of at least 300 seconds as defined by JIS-P 8119 is preferable in view of dot reproducibility.

As stated above, the support used in the present invention preferably has the undercoat layer. As the undercoat layer, a layer containing a pigment and a binder as main components is preferable.

As the pigment, all general inorganic and organic pigments are available. Especially, an oil-absorbable pigment having an oil absorption of at least 40 ml/100 g (cc/100 g) as defined by JIS-K 5101 is preferable. Examples of the oil-absorbable pigment can include calcined kaolin, aluminum oxide, magnesium carbonate, calcium carbonate, amorphous silica, calcined diatomaceous earth, aluminum silicate, magnesium aluminosilicate and aluminum oxide. Of these, calcined kaolin having an oil absorption of from 70 to 80 ml/100 g as defined by JIS-K 5101 is especially preferable.

The binder used in the undercoat layer includes water-soluble polymers and aqueous binders. These may be used either singly or in combination.

Examples of the water-soluble polymers include starch, polyvinyl alcohol, polyacrylamide, carboxymethyl alcohol, methylcellulose and casein.

The aqueous binders are generally synthetic rubber latexes and synthetic resin emulsions. Specific examples thereof include a styrene-butadiene rubber latex (SBR), an acrylonitrile-butadiene rubber latex, a methyl acrylate-butadiene rubber latex and a vinyl acetate emulsion.

The amounts of these binders are determined in consideration of a film strength of the coating layer and a heat sensitivity of the heat-sensitive color-developing layer. The amount of the binders are from 3 to 100% by mass, preferably from 5 to 50% by mass, especially preferably from 8 to 15% by mass relative to the pigment added to the undercoat layer. Further, the undercoat layer may contain a wax, an erasing inhibitor and a surfactant.

The undercoat layer can be coated by a known coating method. Specifically, a method using an air knife coater, a roll coater, a blade coater, a gravure coater or a curtain coater is available. Among others, a blade coating method using a blade coater is preferable. Further, smooth treatment using a calender may be applied as required.

The method using the blade coater includes not only a coating method using a bevel-type or bent-type blade but also a coating method using a rod blade or a bill blade. Further, coating may be conducted by not only an off-machine coater but also an on-machine coater installed on a paper machine. For imparting a fluidity in blade coating to obtain an excellent smoothness and an excellent surface condition, carboxymethylcellulose having a degree of etherification of from 0.6 to 0.8 and a weight average molecular weight of from 20,000 to 200,000 may be added to the coating solution for the undercoat layer in an amount of from 1 to 5% by mass, and preferably from 1 to 3% by mass relative to the pigment.

The coating amount of the undercoat layer is not particularly limited but in view of the properties of the heat-sensitive recording material, this coating amount is at least 2 $g/m^2$, preferably at least 4 $g/m^2$, and especially preferably from 7 $g/m^2$ to 12 $g/m^2$.

(Protective Layer)

The protective layer can be disposed, as required, on the heat-sensitive color-developing layer. The formation of the protective layer can improve the image stability and the chemical resistance. The protective layer can contain a binder, a surfactant, an organic or inorganic pigment and a heat-meltable substance.

Examples of the binder include polyvinyl alcohol, modified polyvinyl alcohol, starch, modified starches such as oxidized starch and urea phosphate starch, carboxyl group-containing polymers such as a styrene-maleic anhydride copolymer, a styrene-maleic anhydride copolymer alkyl ester and a styrene-acrylic acid copolymer, a vinyl acetate-acrylamide copolymer, methylcellulose, carboxymethylcellulose, hydroxymethylcellulose, gelatins, gum arabic, casein, polyacrylamide derivatives, polyvinyl pyrrolidone, a styrene-butadiene rubber latex, an acrylonitrile-butadiene rubber latex, a methyl acrylate-butadiene rubber latex and a vinyl acetate emulsion. Of these, water-soluble polymers are preferable.

As the water-soluble polymers, polyvinyl alcohol, oxidized starch and urea phosphate starch are preferable. A mixture of the polyvinyl alcohol (v) and the oxidized starch and/or the urea phosphate starch (w) at a mass ratio (v/w) of from 90/10 to 10/90 is more preferable. In case of a combination of the oxidized starch and the urea phosphate starch, namely, a combination of polyvinyl alcohol, oxidized starch and urea phosphate starch, it is preferable to use oxidized starch ($W^1$) and urea phosphate starch ($W^2$) at a mass ratio ($W^1/W^2$) of from 10/90 to 90/10.

As the modified polyvinyl alcohol, acetoacetyl-modified polyvinyl alcohol, diacetone-modified polyvinyl alcohol, silicon-modified polyvinyl alcohol and amide-modified polyvinyl alcohol are preferably used. Further, sulfo-modified polyvinyl alcohol and carboxy-modified polyvinyl alcohol can be used. When these polyvinyl alcohols are used in combination with a crosslinking agent reactive therewith, better results can be obtained.

The content of the water-soluble polymer is preferably from 10 to 90% by mass, and more preferably from 30 to 70% by mass relative to the solid content of the coating solution for the protective layer.

Preferable examples of the crosslinking agent include polyvalent amine compounds such as ethylenediamine, polyvalent aldehyde compounds such as glyoxal, glutaraldehyde and dialdehyde, dihydrazide compounds such as adipic acid dihydrazide and phthalic acid dihydrazide, water-soluble methylol compounds (urea, melamine and phenol), polyfunctional epoxy compounds and polyvalent metal salts (Al, Ti, Zr and Mg). When the crosslinking agent is used in combination with polyvinyl alcohol, the amount of the crosslinking agent is preferably from 2 to 30% by mass, more preferably from 5 to 20% by mass relative to polyvinyl alcohol. The use of the crosslinking agent can improve the film strength and the water resistance. As the crosslinking agent used in the present invention, polyvalent aldehyde compounds and dihydrazide compounds are preferable.

As the inorganic pigment, for example, aluminum hydroxide and kaolin are preferable. In view of the color optical density by recording with the thermal head, aluminum hydroxide having an average particle size of from 0.5 to 0.9 $\mu$m is preferable. Further, as the inorganic pigment, calcium carbonate, zinc oxide, aluminum oxide, titanium dioxide, silicon dioxide, barium sulfate, zinc sulfate, talc, clay, calcined clay and colloidal silica are available. As the organic pigment, a urea-formalin resin, a styrene-methacrylic acid copolymer and polystyrene are available.

The amount of the inorganic pigment is preferably from 10 to 90% by mass, and more preferably from 30 to 70% by mass relative to the solid content of the coating solution for the protective layer.

When the protective layer comprises the inorganic pigment and the water-soluble polymer, the mixing ratio thereof varies with the type and the particle size of the inorganic pigment and the type of the water-soluble polymer. The amount of the water-soluble polymer is preferably from 50 to 400% by mass, more preferably from 100 to 250% by mass relative to the inorganic pigment. The total amount of the inorganic pigment and the water-soluble polymer contained in the protective layer is preferably at least 50% by mass of the protective layer.

In the present invention, the addition of the surfactant to the coating solution for the protective layer can further improve the chemical resistance. Preferable examples of the surfactant include alkylbenzenesulfonates such as sodium dodecylbenzenesulfonate, alkylsulfosuccinates such as sodium dioctylsulfosuccinate, polyoxyethylenealkyl ether phosphates, sodium hexametaphosphate and perfluoroalkyl carboxylates. Of these, alkylsulfosuccinates are preferable. The amount of the surfactant is preferably from 0.1 to 5% by mass, and more preferably from 0.5 to 3% by mass relative to the solid content of the coating solution for the protective layer.

The coating solution for the protective layer can contain a lubricant, a defoamer, a fluorescent brightener and an organic color pigment unless this would impair the effects of the present invention are impaired. Examples of the lubricant include metallic soaps such as zinc stearate and calcium stearate, and waxes such as a paraffin wax, a microcrystalline wax, a carnauba wax and a synthetic polymer wax.

EXAMPLES

The present invention is illustrated specifically below by referring to Examples. However, the present invention is not limited to these Examples. Further, "parts" and "%" in Examples are "parts by mass" and "% by mass" unless otherwise indicated. In Examples, "average particle size" indicates "volume-average particle size", showing a value measured with "LA500", manufactured by Horiba Ltd.

(Examples and Comparative Examples of the First Aspect of the Heat-sensitive Recording Material)

Example 1

<Preparation of a Coating Solution for a Heat-sensitive Color-developing Layer>

Preparation of Dispersion A

The following components were mixed while being dispersed with a sand mill to obtain dispersion A having an average particle size of 0.7 μm.

| Composition of dispersion A | |
|---|---|
| 2-Anilino-3-methyl-6-diethylaminofluoran (electron-donating colorless dye) | 10 parts |
| Polyvinyl alcohol 2.5% solution ("PVA-105", made by Kuraray Co., Ltd.) | 50 parts |

Preparation of Dispersion B

The following components were mixed while being dispersed with a sand mill to obtain dispersion B having an average particle size of 0.7 μm.

| Composition of dispersion B | |
|---|---|
| 4-Hydroxybenzenesulfonanilide (electron-accepting compound) | 20 parts |
| Polyvinyl alcohol 2.5% solution ("PVA-105", made by Kuraray Co., Ltd.) | 100 parts |

Preparation of Dispersion C

The following components were mixed while being dispersed with a sand mill to obtain dispersion C having an average particle size of 0.7 μm.

| Composition of dispersion C | |
|---|---|
| 2-Benzyloxynaphthalene (sensitizer) | 20 parts |
| Polyvinyl alcohol 2.5% solution ("PVA-105", made by Kuraray Co., Ltd.) | 100 parts |

Preparation of Dispersion D

The following components were mixed while being dispersed with a sand mill to obtain dispersion D having an average particle size of 0.7 μm.

| Composition of dispersion D | |
|---|---|
| 1,1,3-Tris(2-methyl-4-hydroxy-5-tert-butylphenyl)butane (image stabilizer) | 5 parts |
| Polyvinyl alcohol 2.5% solution ("PVA-105", made by Kuraray Co., Ltd.) | 25 parts |

Preparation of Pigment Dispersion E

The following components were mixed while being dispersed with a sand mill to obtain dispersion E having an average particle size of 2.0 μm.

| Composition of pigment dispersion E | |
|---|---|
| Precipitated calcium carbonate | 40 parts |
| Sodium polyacrylate | 1 part |
| Water | 60 parts |

The compounds according to the following composition were mixed to obtain a coating solution for a heat-sensitive color-developing layer.

| Composition of a coating solution for a heat-sensitive color-developing layer | |
|---|---|
| Dispersion A | 60 parts |
| Dispersion B | 120 parts |
| Dispersion C | 120 parts |
| Dispersion D | 30 parts |
| Pigment dispersion E | 101 parts |
| Ethylenebisstearic acid amide (sensitizer) emulsion dispersion (20%) | 50 parts |
| Zinc stearate 30% dispersion | 15 parts |
| Paraffin wax (30%) | 15 parts |
| Sodium dodecylbenzenesulfonate (25%) | 4 parts |

Preparation of a Coating Solution for a Support Undercoat Layer

The following components were stirred and mixed with a dissolver, and 20 parts of a SBR latex (48%) and 25 parts of oxidized starch (25%) were added to obtain a coating solution for a support undercoat layer.

| Composition of a coating solution for a support undercoat layer | |
|---|---|
| Calcined kaolin (oil absorption 75 ml/100 g) | 100 parts |
| Sodium hexametaphosphate | 1 part |
| Distilled water | 110 parts |

Production of a Heat-sensitive Recording Material

The foregoing coating solution for the support undercoat layer was coated on a base paper having a weight of 50 g/m$^2$ with a blade coater such that a coating amount after drying reached 8 g/m$^2$, and was dried to produce an undercoat base paper. Subsequently, the coating solution for the heat-sensitive color-developing layer was coated on the surface of the undercoat layer with a curtain coater such that a coating amount after drying reached 4.5 g/m$^2$, and was then dried. The surface of the resulting heat-sensitive color-developing layer was subjected to calender treatment to obtain a heat-sensitive recording material of Example 1.

Example 2

A heat-sensitive recording material of Example 2 was obtained in the same manner as in Example 1 except that the amount of dispersion C was changed from 120 parts to 150 parts and the amount of the ethylenebisstearic acid amide emulsion dispersion (20%) from 50 parts to 12.5 parts respectively.

Example 3

A heat-sensitive recording material of Example 3 was obtained in the same manner as in Example 1 except that the amount of dispersion C was changed from 120 parts to 165 parts and the amount of the ethylenebisstearic acid amide emulsion dispersion (20%) from 50 parts to 12.5 parts respectively.

Example 4

A heat-sensitive recording material of Example 4 was obtained in the same manner as in Example 1 except that the amount of dispersion C was changed from 120 parts to 75 parts and the amount of the ethylenebisstearic acid amide emulsion dispersion (20%) from 50 parts to 87.5 parts respectively.

Example 5

A heat-sensitive recording material of Example 5 was obtained in the same manner as in Example 1 except that 1,1,3-tris(2-methyl-4-hydroxy-5-tert-butylphenyl)butane of dispersion D was replaced with 1,1,3-tris(2-methyl-4-hydroxy-5-cyclohexylphenyl)butane.

Example 6

A heat-sensitive recording material of Example 6 was obtained in the same manner as in Example 1 except that the amount of dispersion D was changed from 30 parts to 10 parts.

Example 7

A heat-sensitive recording material of Example 7 was obtained in the same manner as in Example 1 except that in Example 1, the amount of dispersion D was changed from 30 parts to 70 parts.

Example 8

A heat-sensitive recording material of Example 8 was obtained in the same manner as in Example 1 except that dispersion D was not used.

Example 9

A heat-sensitive recording material of Example 9 was obtained in the same manner as in Example 1 except that the coating solution for the heat-sensitive color-developing layer was coated with an air knife coater instead of the curtain coater.

Example 10

A heat-sensitive recording material of Example 10 was obtained in the same manner as in Example 6 except that before subjecting the resulting heat-sensitive color-developing layer to calender treatment, the following coating solution for a protective layer was further coated on the heat-sensitive color-developing layer with a curtain coater such that a coating amount after drying reached 2 g/m$^2$, and was dried to form a protective layer and the surface of the protective layer was subjected to calender treatment.

Preparation of a Coating Solution for a Protective Layer

Compounds according to the following composition were first dispersed with a sand mill to prepare a pigment dispersion having an average particle size of 2 $\mu$m. Subsequently, 60 parts of water was added to 200 parts of a urea phosphate starch 15% aqueous solution ("MS4600", made by Nihon Shokuhin Kako Co., Ltd.) and a polyvinyl alcohol 15% aqueous solution ("PVA-105", made by Kuraray Co., Ltd.). The resulting solution was further mixed with the foregoing pigment dispersion and then with 25 parts of a zinc stearate emulsion dispersion ("HIDORIN F115", made by Chukyo Yushi Co., Ltd.) having an average particle size of 0.15 $\mu$m and 125 parts of a sulfosuccinic acid 2-ethylhexyl ester sodium salt 2% aqueous solution to obtain a coating solution for a protective layer.

| Composition of a coating solution for a protective layer | |
|---|---|
| Aluminum hydroxide (average particle size 1 $\mu$m) ("HIGILITE H42", made by Showa Denko Co., Ltd.) | 40 parts |
| Sodium polyacrylate | 1 part |
| Water | 60 parts |

Example 11

A heat-sensitive recording material of Example 10 was obtained in the same manner as in Example 1 except that the precipitated calcium carbonate used in pigment dispersion E was replaced with amorphous silica ("MIZUKASIL" P78A", made by Mizusawa Kagaku Co., Ltd.).

Example 12

A heat-sensitive recording material of Example 12 was obtained in the same manner as in Example 1 except that a polyaminepolyamide epichlorohydrin aqueous solution (trade name: "ARAFIX 300", made by Arakawa Kagaku Co., Ltd.) was further added to the coating solution of the heat-sensitive color-developing layer of Example 12 as a mordant.

Comparative Example 1

A heat-sensitive recording material of Comparative Example 1 was obtained in the same manner as in Example 1 except that dispersion C was not used and the amount of the ethylenebisstearic acid amide emulsion dispersion (20%) was changed from 50 parts to 60 parts.

Comparative Example 2

A heat-sensitive recording material of Comparative Example 2 was obtained in the same manner as in Example 1 except that the amount of dispersion C was changed from 120 parts to 36 parts and the amount of the ethylenebisstearic acid amide emulsion dispersion (20%) from 50 parts to 120 parts respectively.

Comparative Example 3

A heat-sensitive recording material of Comparative Example 3 was obtained in the same manner as in Example 1 except that 4-hydroxybenzenesulfonanilide of dispersion B was replaced with 2,2-bis(4-hydroxyphenyl)propane (bisphenol A).

Comparative Example 4

A heat-sensitive recording material of Comparative Example 4 was obtained in the same manner as in Example 1 except that the ethylenebisstearic acid amide emulsion dispersion (20%) was not used and the amount of dispersion C was changed from 120 parts to 170 parts.

Comparative Example 5

A heat-sensitive recording material of Comparative Example 5 was obtained in the same manner as in Example 1 except that the 4-hydroxybenzenesulfonaminide as dispersion B was replaced with N-benzyl-4-hydroxybenzenesulfonamide (p-N-benzylsulfamoylphenol).

(Examples and Comparative Examples of the Second Aspect of the Heat-sensitive Recording Material)

Example 13

Preparation of a coating solution for a heat-sensitive color-developing layer Dispersion A, dispersion B, dispersion C, dispersion D and pigment dispersion E were prepared by the same methods as in Example 1 according to the same compositions as in Example 1. Further, the following dispersion F was prepared.

Preparation of Dispersion F

The following components were mixed while being dispersed with a sand mill to obtain dispersion D having an average particle size of 0.7 $\mu$m.

| Composition of dispersion F | |
|---|---|
| Methylolstearic acid amide (sensitizer) | 10 parts |
| Polyvinyl alcohol 2.5% solution ("PVA-105", made by Kuraray Co., Ltd.) | 40 parts |

Compounds according to the following composition were mixed to obtain a coating solution for a heat-sensitive color-developing layer.

| Composition of a coating solution for a heat-sensitive color-developing layer | |
|---|---|
| Dispersion A | 60 parts |
| Dispersion B | 120 parts |
| Dispersion C | 120 parts |
| Dispersion D | 30 parts |
| Pigment dispersion E | 101 parts |
| Dispersion F | 50 parts |
| Zinc stearate 30% dispersion | 15 parts |
| Paraffin wax (30%) | 15 parts |
| Sodium dodecylbenzenesulfonate (25%) | 4 parts |

Preparation of a Coating Solution for a Support Undercoat Layer

A coating solution for a support undercoat layer was prepared by the same method as in Example 1 according to the same composition as in Example 1.

Production of a Heat-sensitive Recording Material

The coating solution for the support undercoat layer was coated on a base paper having a weight of 50 g/m$^2$ with a blade coater such that a coating amount after drying reached 8 g/m$^2$, and was dried to produce a base paper having an undercoat layer. Subsequently, the coating solution for the heat-sensitive color-developing layer was coated on the surface of the undercoat layer such that a coating amount after drying reached 4.5 g/m$^2$, and was then dried. The surface of the resulting heat-sensitive color-developing layer was subjected to calender treatment to obtain a heat-sensitive recording material of Example 13.

Example 14

A heat-sensitive recording material of Example 14 was obtained in the same manner as in Example 13 except that the amount of dispersion C was changed from 120 parts to 150 parts and the amount of dispersion F from 50 parts to 25 parts respectively.

Example 15

A heat-sensitive recording material of Example 15 was obtained in the same manner as in Example 13 except that the amount of dispersion C was changed from 120 parts to 165 parts and the amount of dispersion F from 50 parts to 12.5 parts respectively.

Example 16

A heat-sensitive recording material of Example 16 was obtained in the same manner as in Example 13 except that the amount of dispersion C was changed from 120 parts to 75 parts and the amount of dispersion F from 50 parts to 87.5 parts respectively.

Example 17

A heat-sensitive recording material of Example 17 was obtained in the same manner as in Example 13 except that the 1,1,3-tris(2-methyl-4-hydroxy-5-tert-butylphenyl) butane of dispersion D was replaced with 1,1,3-tris(2-methyl-4-hydroxy-5-cyclohexylphenyl) butane.

Example 18

A heat-sensitive recording material of Example 18 was obtained in the same manner as in Example 13 except that the amount of dispersion D was changed from 30 parts to 10 parts.

Example 19

A heat-sensitive recording material of Example 19 was obtained in the same manner as in Example 13 except that the amount of dispersion D was changed from 30 parts to 50 parts.

Example 20

A heat-sensitive recording material of Example 20 was obtained in the same manner as in Example 13 except that the amount of dispersion D was changed from 30 parts to 3 parts.

Example 21

A heat-sensitive recording material of Example 21 was obtained in the same manner as in Example 13 except that the coating solution for the heat-sensitive color-developing layer was coated with an air knife coater instead of the curtain coater.

Example 22

A heat-sensitive recording material of Example 22 was obtained in the same manner as in Example 18 except that before subjecting the resulting heat-sensitive color-developing layer to calender treatment, the following coating solution for a protective layer was further coated on the heat-sensitive color-developing layer with a curtain coater such that a coating amount after drying reached 2 g/m$^2$ and was dried to form a protective layer and the surface of the protective layer was subjected to calender treatment.

Preparation of a Coating Solution for a Protective Layer

A coating solution for a protective layer was prepared by the same method as in Example 1 according to the same composition as in Example 1.

Example 23

A heat-sensitive recording material of Example 23 was obtained in the same manner as in Example 13 except that the precipitated calcium carbonate used in pigment dispersion E was replaced with amorphous silica (trade name: "MIZUKASIL" P78A", made by Mizusawa Kagaku Co., Ltd.).

Example 24

A heat-sensitive recording material of Example 24 was obtained in the same manner as in Example 13 except that a polyaminepolyamide epichlorohydrin aqueous solution (trade name: "ARAFIX 300", made by Arakawa Chemical Industries Ltd.) was further added to the coating solution for the heat-sensitive color-developing layer of Example 13 as a mordant.

Comparative Example 6

A heat-sensitive recording material of Comparative Example 6 was obtained in the same manner as in Example 13 except that the dispersion C was not used and the amount of dispersion F was changed from 50 parts to 60 parts.

Comparative Example 7

A heat-sensitive recording material of Comparative Example 7 was obtained in the same manner as in Example 13 except that the amount of dispersion C was changed from 120 parts to 36 parts and the amount of dispersion F from 50 parts to 120 parts respectively.

Comparative Example 8

A heat-sensitive recording material of Comparative Example 8 was obtained in the same manner as in Example 13 except that dispersion D was not used.

Comparative Example 9

A heat-sensitive recording material of Comparative Example 9 was obtained in the same manner as in Example 13 except that the 4-hydroxybenzenesulfonanilide of dispersion B was replaced with 2,2-bis(4-hydroxyphenyl)propane [bisphenol A].

Comparative Example 10

A heat-sensitive recording material of Comparative Example 10 was obtained in the same manner as in Example 13 except that the 1,1,3-tris(2-methyl-4-hydroxy-5-tert-butylphenyl)butane of dispersion D was replaced with 2,2'-methylenebis(4-methyl-6-tert-butylphenol).

Comparative Example 11

A heat-sensitive recording material of Comparative Example 11 was obtained in the same manner as in Example 13 except that the dispersion F was not used and the amount of dispersion C was changed from 120 parts to 170 parts.

Comparative Example 12

A heat-sensitive recording material of Comparative Example 12 was obtained in the same manner as in Example 13 except that the 4-hydroxybenzenesulfonanilide of dispersion B was replaced with N-benzyl-4-hydroxybenzenesulfonamide (p-N-benzylsulfamoylphenol).

Evaluation Tests (1) Sensitivity

The heat-sensitive recording materials obtained in Examples 1 to 12 and Comparative Examples 1 to 5 were printed using a heat-sensitive printer having a thermal head ("KJT-216–8 MPD1", manufactured by Kyocera Corp.). The printing was conducted under conditions of a head voltage of 24 V and a pulse period of 10 ms with a pulse width of 1.5 ms, and a printing density was measured with a Macbeth reflection densitometer "RD-918". The results are shown in Tables 1 and 2.

(2) Image Stability

An image was recorded with the same printer as in (1) under the same conditions as in (1) using each of the heat-sensitive recording materials obtained in Examples 1 to 24 and Comparative Examples 1 to 12, and the material was allowed to stand for 24 hours in an atmosphere of 60° C. and relative humidity of 20%. Then, the image density was measured with the Macbeth reflection densitometer "RD-918", and a residual ratio relative to an image density of an untreated material (not allowed to stand) on which an image was recorded with the same printer as in (1) under the same conditions as in (1) was calculated using the following formula. The results are shown in Tables 1 and 2. By the way, the higher the value, the better the image stability.

Image stability (%)=(image density after allowing to stand/image density of untreated material)×100

(3) Chemical Resistance

Each of the heat-sensitive recording materials obtained in Examples 1 to 24 and Comparative Examples 1 to 12 was printed under the same conditions as in (1), and a background area and a surface of a printed area thereof were written on with a fluorescent pen ("ZEBRA FLUORESCENT PEN 2-PINK", manufactured by Zebra Co., LTd.). After 1 day, occurrence of background fogging and a stability of an image area on each of the heat-sensitive recording materials were visually observed, and evaluated according to the following grades. The results are shown in Tables 1 and 2.

○. . . Occurrence of fogging was not observed, nor was a change of an image area observed.

Δ. . . Occurrence of fogging was slightly observed, and erasing of an image area was slightly observed.

x . . . Occurrence of fogging was notably observed, and an image area was erased.

(4) Sticking Property

The heat-sensitive recording materials obtained in Examples 1 to 24 and Comparative Examples 1 to 12 were subjected to printing with a facsimile machine ("SFX85", manufactured by Sanyo Electric Co., Ltd.) and Denshi Gazo Gakkai No. 3 Chart as a test chart. At this time, a printing noise and visually observed deletion were evaluated in combination according to the following grades. The results are shown in Tables 1 and 2.

○. . . No noise except a printing noise was generated, nor was deletion observed.

Δ. . . A noise was slightly generated, and deletion was observed.

x . . . A clear noise (bonding noise) was generated, and deletion was also often observed.

(5) Ink Jet Recordability

A sheet on which characters were typed with a word processor ("RUPO JW-95JV", manufactured by Toshiba Corporation was printed with an ink jet printer, and blotting in ink jet recording and erasing of the characters recorded with the word processor were visually evaluated according to the following grades.

○. . . Characters were slightly blurred but had no problems being reading.

Δ. . . Characters were blurred, but could somehow be read.

x . . . Characters completely disappeared, and could not be read.

(6) Ink Jet Sheet Resistance

An image printed with a high image quality using an ink jet printer ("MJ930C", manufactured by Seiko Epson Corporation) was contacted with a heat-sensitive recording surface of a heat-sensitive recording material printed as in (1) Sensitivity, and allowed to stand at 25° C. for 48 hours. Then, the image density was measured with the Macbeth RD918. Separately, an image density of a non-contacted material was also measured, and a ratio (residual ratio) of the image density of the contacted material to the image density of this material was calculated: the higher the value, the better the ink jet sheet resistance.

TABLE 1

| | Sensitivity | Image Stability (%) | Chemical Resistance | Sticking Property | Ink jet recording Blotting | Ink jet recording Erasing | Ink Jet sheet Resistance (%) |
|---|---|---|---|---|---|---|---|
| Example 1 | 1.31 | 98 | ○ | ○ | ○ | ○ | 95 |
| Example 2 | 1.29 | 95 | ○ | ○ | ○ | ○ | 93 |
| Example 3 | 1.26 | 95 | ○ | ○ | ○ | ○ | 93 |
| Example 4 | 1.28 | 94 | ○ | ○ | ○ | ○ | 92 |
| Example 5 | 1.28 | 78 | ○ | ○ | ○ | ○ | 85 |
| Example 6 | 1.28 | 79 | Δ | ○ | ○ | ○ | 88 |
| Example 7 | 1.26 | 97 | ○ | Δ | ○ | ○ | 96 |
| Example 8 | 1.28 | 73 | Δ | ○ | ○ | ○ | 80 |
| Example 9 | 1.28 | 96 | ○ | ○ | ○ | ○ | 97 |
| Example 10 | 1.23 | 84 | ○ | ○ | ○ | ○ | 88 |
| Example 11 | 1.25 | 98 | ○ | ○ | ○○ | ○ | 96 |
| Example 12 | 1.23 | 98 | ○ | ○ | ○○ | ○ | 97 |
| Comparative Example 1 | 1.22 | 37 | Δ | ○ | ○ | ○ | 65 |
| Comparative Example 2 | 1.24 | 44 | Δ | ○ | ○ | ○ | 70 |
| Comparative Example 3 | 1.22 | 70 | X | Δ | ○ | Δ | 35 |
| Comparative Example 4 | 1.17 | 94 | ○ | ○ | ○ | ○ | 95 |
| Comparative Example 5 | 1.16 | 70 | ○ | ○ | ○ | ○ | 82 |

From Table 1, it was found that the heat-sensitive recording materials obtained in Examples 1 to 12 of the present invention were excellent in the sensitivity, the image stability of the color image, the chemical resistance, the sticking property, the ink jet recordability (blotting and erasing) and the ink jet sheet resistance thereof.

Comparison of Examples 1, 5 and 8 revealed that incorporating of the image stabilizer provided the excellent image stability. Especially, a comparison of Example 1 with Example 6 revealed that when the amount of the image stabilizer relative to the electron-donating colorless dye was 20 parts by mass or more, the image stability and the chemical resistance were much improved. Likewise, comparison of Example 1 with Example 7 revealed that when the amount was 100 parts by weight or less, the sticking property was much improved.

Comparison of Example 1 with Example 9 revealed that when the heat-sensitive color-developing layer was coated with the curtain coater, the sensitivity and the image stability were excellent.

Comparison of Example 6 with Example 10 revealed that the image stability and the chemical resistance were improved by the formation of the protective layer.

In contrast, Table 1 showed that in Comparative Example 1 in which 2-benzyloxynaphthalene was not used, the image stability was especially poor. In Comparative Example 2 in which the 2-benzyloxynaphthalene to ethylenebisstearic acid amide mass ratio was outside the range of 95/5 to 40/60, the image stability was especially poor.

In Comparative Example 3 in which bisphenol A was used as the electron-accepting compound, the image stability and the sticking property were slightly poor, and the chemical resistance was notably poor. In Comparative Example 5 in which N-benzyl-4-hydroxybenzenesulfonamide was used as the electron-accepting compound, the image stability was slightly poor, and the sensitivity was notably poor.

TABLE 2

| | Sensitivity | Image Stability (%) | Chemical Resistance | Sticking Property | Ink jet recording Blotting | Ink jet recording Erasing | Ink Jet sheet Resistance (%) |
|---|---|---|---|---|---|---|---|
| Example 13 | 1.29 | 96 | ○ | ○ | ○ | ○ | 97 |
| Example 14 | 1.27 | 94 | ○ | ○ | ○ | ○ | 95 |
| Example 15 | 1.25 | 95 | ○ | ○ | ○ | ○ | 96 |
| Example 16 | 1.26 | 94 | ○ | ○ | ○ | ○ | 95 |
| Example 17 | 1.26 | 78 | ○ | ○ | ○ | ○ | 82 |
| Example 18 | 1.26 | 79 | Δ | ○ | ○ | ○ | 81 |
| Example 19 | 1.25 | 96 | ○ | Δ | ○ | ○ | 97 |
| Example 20 | 1.26 | 69 | Δ | ○ | ○ | ○ | 75 |
| Example 21 | 1.26 | 95 | ○ | ○ | ○ | ○ | 98 |
| Example 22 | 1.23 | 99 | ○ | ○ | ○ | ○ | 99 |
| Example 23 | 1.25 | 96 | ○ | ○ | ○○ | ○ | 97 |
| Example 24 | 1.22 | 96 | ○ | ○ | ○○ | ○ | 98 |
| Comparative Example 6 | 1.20 | 38 | Δ | ○ | ○ | ○ | 65 |
| Comparative Example 7 | 1.22 | 46 | Δ | ○ | ○ | ○ | 67 |
| Comparative Example 8 | 1.19 | 36 | Δ | Δ | ○ | ○ | 35 |

TABLE 2-continued

| | Sensitivity | Image Stability (%) | Chemical Resistance | Sticking Property | Ink jet recording Blotting | Ink jet recording Erasing | Ink Jet sheet Resistance (%) |
|---|---|---|---|---|---|---|---|
| Comparative Example 9 | 1.22 | 70 | X | Δ | ○ | Δ | 75 |
| Comparative Example 10 | 1.26 | 40 | Δ | X | ○ | ○ | 55 |
| Comparative Example 11 | 1.16 | 93 | ○ | ○ | ○ | ○ | 95 |
| Comparative Example 12 | 1.17 | 72 | ○ | ○ | ○ | ○ | 80 |

From Table 2, it was found that the heat-sensitive recording materials obtained in Examples 13 to 24 of the present invention were excellent in the sensitivity, the image stability of the color image, the chemical resistance, the sticking property, the ink jet recordability (blotting and erasing) and the ink jet sheet resistance thereof.

A comparison of Example 13 with Examples 18 and 20 revealed that when the amount of the image stabilizer relative to the electron-donating colorless dye was 10 parts by mass or more, especially 20 parts by mass or more, the image stability and the chemical resistance were far better. Likewise, comparison of Example 13 with Comparative Example 19 revealed that when the amount was 60 parts by mass or less, the sticking property was far better.

Comparison of Example 13 with Example 21 revealed that when the heat-sensitive color-developing layer was coated with the curtain coater, the sensitivity and the image stability were excellent.

Likewise, comparison of Example 18 with Example 22 revealed that the image stability and the chemical resistance were all the more improved by the formation of the protective layer.

In contrast, in Comparative Example 6 in which 2-benzyloxynaphthalene was not used, the image stability was found to be especially poor. In Comparative Example 7 in which the 2-benzyloxynaphthalene to methylolstearic acid amide mass ratio was outside the range of 95/5 to 40/60, the image stability was especially poor. In Comparative Example 8 in which the image stabilizer was not used, the image stability was especially poor.

In Comparative Example 9 in which bisphenol A was used as the electron-accepting compound and Comparative Example 12 in which N-bezyl-4-hydroxybenzenesulfonamide was used as the electron-accepting compound, the image stability and the sticking property were slightly poor, and the chemical resistance was notably poor. In Comparative Example 10 using the image stabilizer except the image stabilizer of the present invention, the image stability and the sticking property were especially poor.

As has been thus far stated, the present invention can provide, in comparison with the ordinary heat-sensitive recording materials, the heat-sensitive recording materials which have the high color optical density and are excellent in the stability of the image area, the chemical resistance, the sticking property, the ink jet recordability and the ink jet sheet resistance.

What is claimed is:

1. A heat-sensitive recording material comprising a support having disposed thereon a heat-sensitive color-developing layer including an electron-donating colorless dye, 4-hydroxybenzenesulfoanilide as an electron-accepting compound, and 2-benzyloxynaphthalene and ethylenebisstearic acid amide as a sensitizer, wherein a mass ratio (x/y) of the 2-benzyloxynaphthalene (x) to the ethylenebisstearic acid amide (y) is from 95/5 to 40/60.

2. The heat-sensitive recording material according to claim 1, wherein a dry weight coating amount of the electron-donating colorless dye is from 0.1 to 1.0 g/m$^2$.

3. The heat-sensitive recording material according to claim 1, wherein the amount of the 4-hydroxybenzenesulfonanilide is from 50 to 400% by mass relative to the electron-donating colorless dye.

4. The heat-sensitive recording material according to claim 1, wherein the total amount of the sensitizer comprises from 75 to 200 parts by mass relative to 100 parts by mass of the 4-hydroxybenzenesulfonanilide.

5. The heat-sensitive recording material according to claim 1, wherein the heat-sensitive color-developing layer further comprising, as an image stabilizer, at least one of 1,1,3-tris(2-methyl-4-hydroxy-5-tert-butylphenyl)butane and 1,1,3-tris(2-methyl-4-hydroxy-5-cyclohexylphenyl)butane.

6. The heat-sensitive recording material according to claim 2, wherein the amount of the image stabilizer comprises from 10 to 100 parts by mass relative to 100 parts by mass of the electron-donating colorless dye.

7. The heat-sensitive recording material according to claim 1, wherein the heat-sensitive color-developing layer further comprising, as an inorganic pigment, at least one selected from the group consisting of precipitated calcium carbonate, calcium hydroxide and amorphous silica.

8. The heat-sensitive recording material according to claim 1, wherein the heat-sensitive color-developing layer further comprising, as a mordant, a compound including at least one cationic group selected from the group consisting of amide groups, imide groups, primary amino groups, secondary amino groups, tertiary amino groups, primary ammonium salt groups, secondary ammonium salt groups, tertiary ammonium salt groups and quaternary ammonium salt groups.

9. The heat-sensitive recording material according to claim 1, wherein the heat-sensitive color-developing layer is formed by coating with a curtain coater and drying.

10. The heat-sensitive recording material according to claim 1, further comprising a protective layer disposed on the heat-sensitive recording layer.

11. A heat-sensitive recording material comprising a support having disposed thereon a heat-sensitive color-developing layer including an electron-donating colorless dye, 4-hydroxybenzenesulfoanilide as an electron-accepting compound, 2-benzyloxynaphthalene and methylolstearic acid amide as a sensitizer, and 1,1,3-tris(2-methyl-4-hydroxy-5-tert-butylphenyl)butane and 1,1,3-tris(2-methyl-4-hydroxy-5-cyclohexylphenyl)butane as an image stabilizer, wherein a mass ratio (x/y) of the 2-benzyloxynaphthalene (x) to the methylolstearic acid amide (y) is from 95/5 to 40/60.

12. The heat-sensitive recording material according to claim 11, wherein a dry weight coating amount of the electron-donating colorless dye comprises from 0.1 to 1.0 $g/m^2$.

13. The heat-sensitive recording material according to claim 11, wherein the amount of the image stabilizer comprises from 10 to 100 parts by mass relative to 100 parts by mass relative to the electron-donating colorless dye.

14. The heat-sensitive recording material according to claim 11, wherein the amount of 4-hydroxybenzenesulfonanilide as the electron-accepting compound comprises from 50 to 400% by mass relative to the electron-donating colorless dye.

15. The heat-sensitive recording material according to claim 11, wherein the total amount of the sensitizer comprises from 75 to 200 parts by mass relative to 100 parts by mass of the 4-hydroxybenzenesulfonanilide.

16. The heat-sensitive recording material according to claim 11, wherein the heat-sensitive color-developing layer further comprising, as an inorganic pigment, at least one selected from the group consisting of precipitated calcium carbonate, calcium hydroxide and amorphous silica.

17. The heat-sensitive recording material according to claim 11, wherein the heat-sensitive color-developing layer further comprising, as a mordant, a compound including at least one cationic group selected from the group consisting of amide groups, imide groups, primary amino groups, secondary amino groups, tertiary amino groups, primary ammonium salt groups, secondary ammonium salt groups, tertiary ammonium salt groups and quaternary ammonium salt groups.

18. The heat-sensitive recording material according to claim 11, wherein the heat-sensitive color-developing layer is formed by coating with a curtain coater and drying.

19. The heat-sensitive recording material according to claim 11, further comprising a protective layer disposed on the heat-sensitive recording.

* * * * *